US005681245A

United States Patent [19]

Lin

[11] Patent Number: 5,681,245

[45] Date of Patent: Oct. 28, 1997

[54] WALKING EXERCISER

[75] Inventor: Chin Ta Lin, Taichung Hsien, Taiwan

[73] Assignee: Hua Yeong Enterprise Co., Ltd., Taiwan

[21] Appl. No.: 778,103

[22] Filed: Jan. 2, 1997

[51] Int. Cl.[6] ..... A63B 22/00

[52] U.S. Cl. ..... 482/51; 482/52

[58] Field of Search ..... 482/51, 52, 53, 482/79, 80, 54, 148, 70; 434/255

[56] References Cited

U.S. PATENT DOCUMENTS

| | | | |
|---|---|---|---|
| 5,496,235 | 3/1996 | Stevens | 482/51 |
| 5,584,780 | 12/1996 | Lin | 482/52 |
| 5,603,675 | 2/1997 | Wu | 482/52 |
| 5,613,924 | 3/1997 | Lee | 482/51 |
| 6,384,781 | 12/1996 | Chen | 482/52 |

*Primary Examiner*—Stephen R. Crow
*Attorney, Agent, or Firm*—Alfred Lei

[57] ABSTRACT

A walking exerciser including two J-shaped frames each provided with a circular disk at an outer end thereof and a pedal at a lower end thereof, a H-shaped frame having two upper ends, two connectors each fixedly mounted on one of the upper ends of the H-shaped frame, each of the connectors including a tubular member having a circular hole, two cylindrical plugs each force-fitted into one end of the tubular member, a first curved member fixedly installed on an upper end of the tubular member, and a second curved member fixedly mounted on a lower end of the tubular member, two shafts each extending through the tubular member, a U-shaped frame having two upper ends each pivotally connected with the first curved member of the connectors, and a handlebar having two arms pivotally connected with the second curved member of the connectors, whereby the walking exerciser can be easily collapsed when not is use.

4 Claims, 4 Drawing Sheets

WALKING EXERCISER

CROSS-REFERENCE

This application is related to the patent application Ser. No. 08/629,150, filed Apr. 8, 1996, now U.S. Pat. No. 5,584,780, granted Dec. 17, 1996.

BACKGROUND OF THE INVENTION

1. Field of the Invention

This invention is related to a walking exerciser and in particular to one which is collapsible.

2. Description of the Prior Art

A variety of exercising apparatuses such as. exer-hikers, rowing machines, stationary bicycles, etc. have been developed for exercising different parts of the body, and have appeared on the market. However, these exercising apparatuses are commonly heavy, expensive, not collapsible, and not suitable for home use.

Therefore, it is an object of the present invention to provide a walking exercise which can obviate and mitigate the above-mentioned drawbacks.

SUMMARY OF THE INVENTION

This invention is concerned with a walking exerciser which is practical in use for exercising walking.

It is the primary object of the present invention to provide a walking exerciser which can be easily collapsed.

It is another object of the present invention to provide a walking exerciser which is convenient for transportation and stowage.

It is still another object of the present invention to provide a walking exerciser which is inexpensive to manufacuture.

It is still another object of the present invention to provide a walking exerciser which needs little installation space.

It is a further object of the present invention to provide a walking exerciser which is simple in construction.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
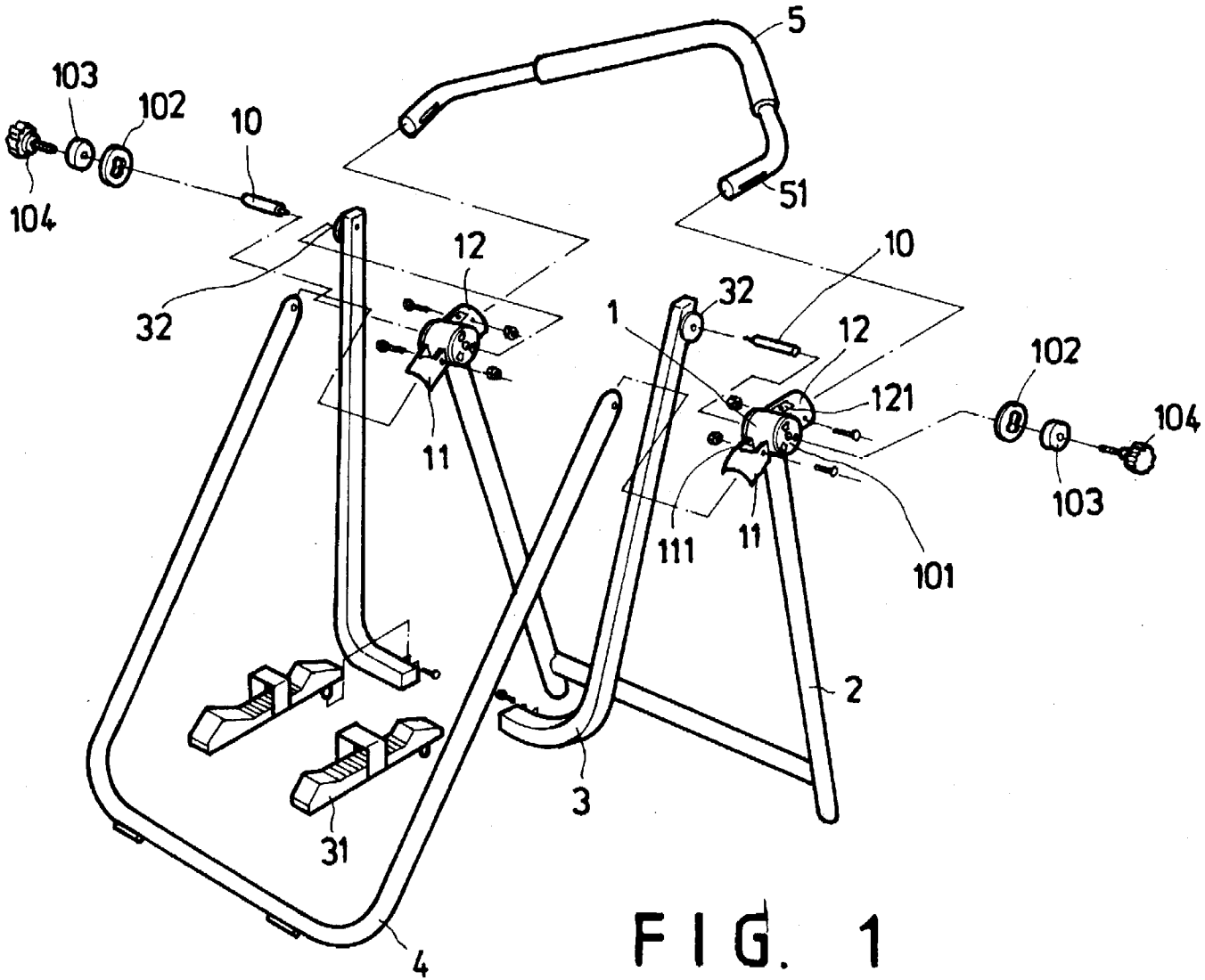
FIG. 1 is an exploded view of the present invention.
Figure 2A:
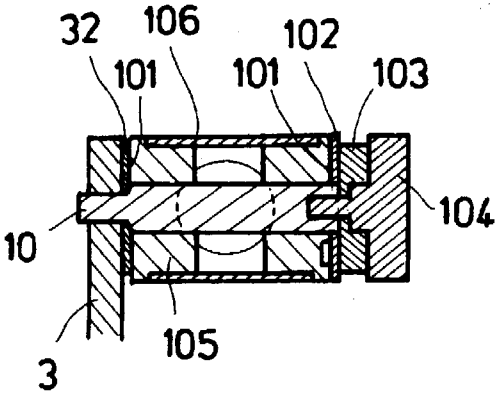
FIG. 2A is a sectional view taken along line 2A—2A of FIG. 2.
Figure 2:
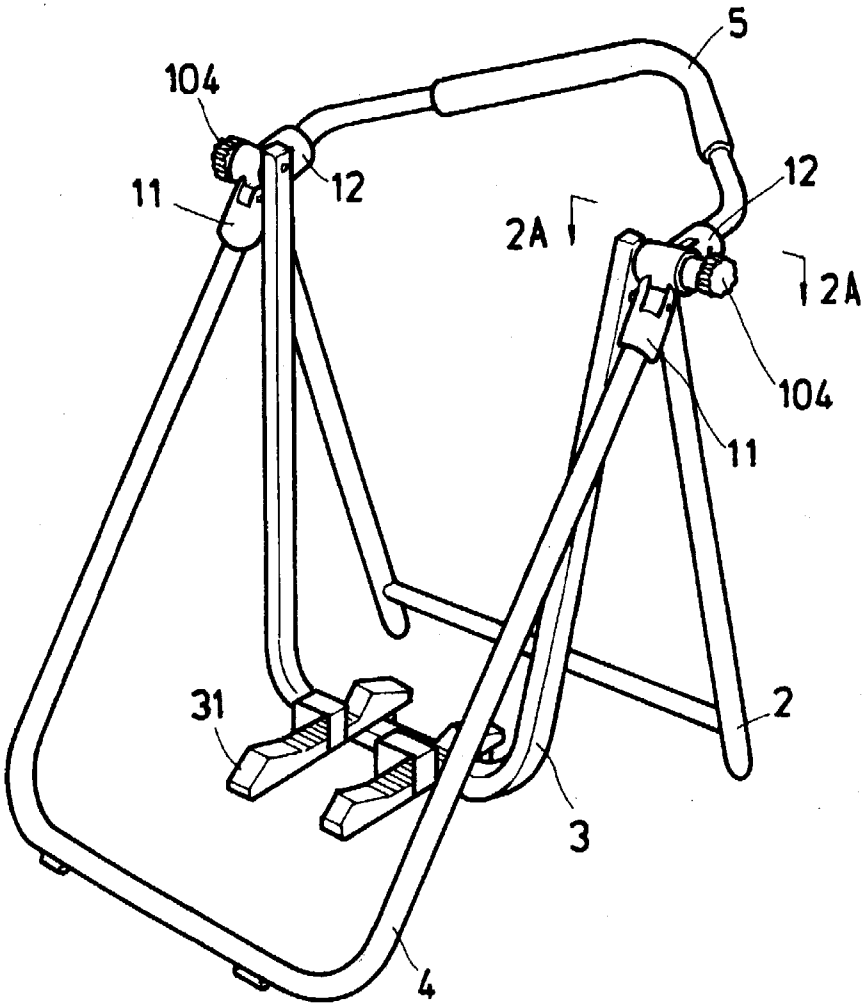
FIG. 2 is a perspective view of the present invention.

With reference to the drawings and in particular to FIGS. 1 and 2 thereof, the walking exerciser according to the present invention basically comprises a H-shaped frame 2, a U-shaped frame 4, two J-shaped frames 3, a handlebar 5, two connectors 1 and two pedals 31.

The H-shaped frame 2, the U-shaped frame 4, the two J-shaped frames 3 and the handlebar 5 are pivotally connected to the connectors 1. The pedal 31 is pivotally mounted on the lower end of the J-shaped frame 3 by screws.

A circular disk 10 is welded on the upper end of the J-shaped frame 3. A shaft 10 extends through the circular disk 10 into the upper end of the J-shaped frame 3 and fixedly mounted thereon by welding.

Figure 4:
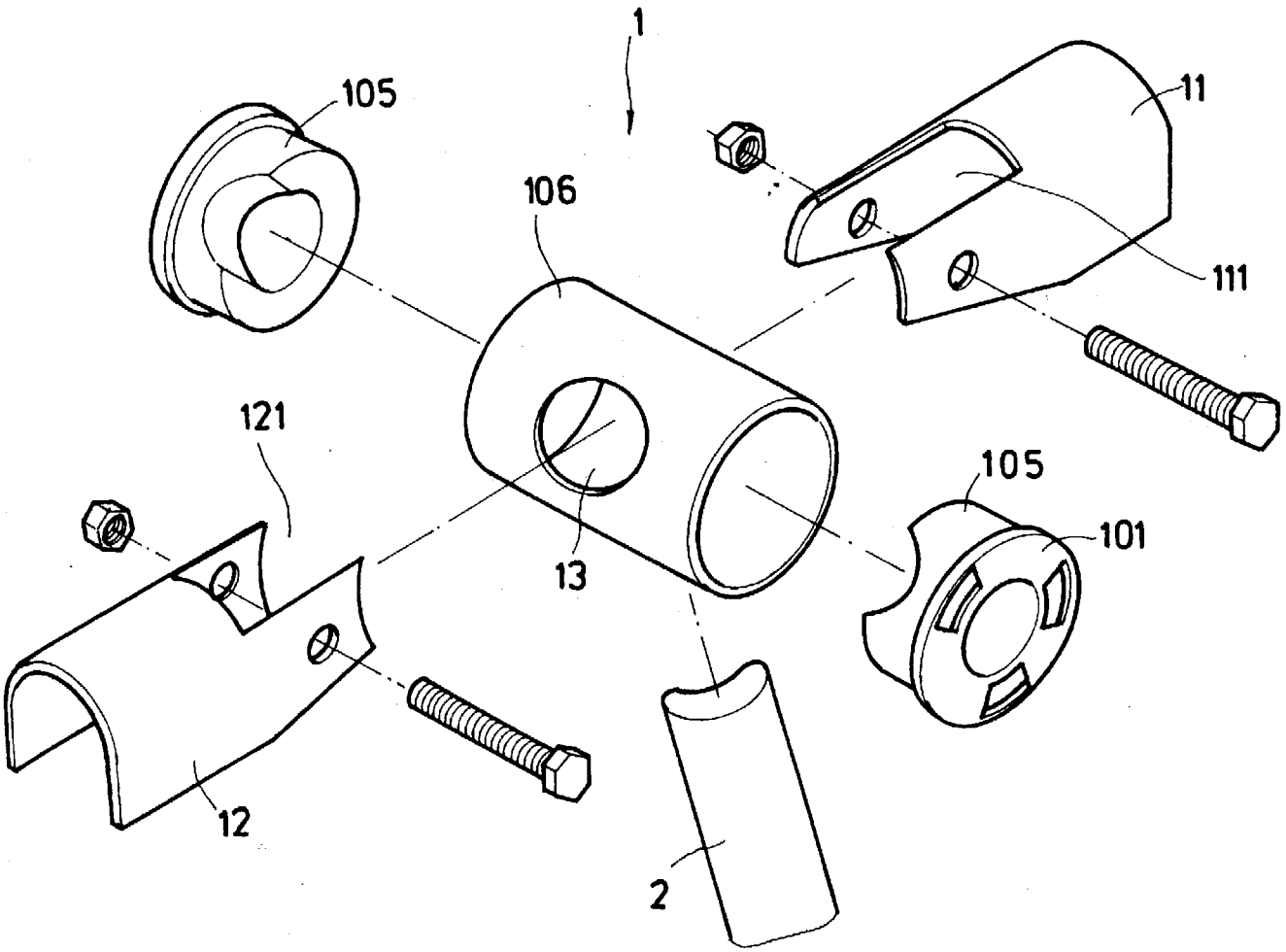
FIG. 4 is an exploded view of the connector.

Referring to FIGS. 1 and 4, each of the connectors 1 includes a tubular member 106 having a circular hole 13, two cylindrical plugs 105 each force-fitted into one end of the tubular members 106, a first curved member 11 welded on an upper portion of the tubular member 106, and a second curved member 12 welded on a lower portion of the tubular member 106. The curved members 11 and 12 are formed with recesses 111 and 121 for enabling the handlebar 5 and the U-shaped frame 4 to rotate with respect thereto. Each of the tubular member 106 is welded on an upper end of the H-shaped frame 2. The handlebar 5 has two arms each extending through a curved member 12 into the hole 13 of a tubular member 106 and each having an elongated slot 51 at the end. The handlebar 5 is pivotally connected with the curved member 12 by a screw extending through the curved member 12 and the elongated slot 51 of the handlebar 5. The U-shaped frame 4 has two upper ends each pivotally connected with a curved member 11 by a screw. Each of the cylindrical plugs 105 is provided with a damping surface 101 at the outer end. A packing 102 is mounted on outer end of the tubular member 106 and a sleeve 103 is arranged on the packing 102. A knob 104 having a screw rod is threadedly engaged with an outer end of the shaft 10 (see FIGS. 1 and 2A).

Figure 3:
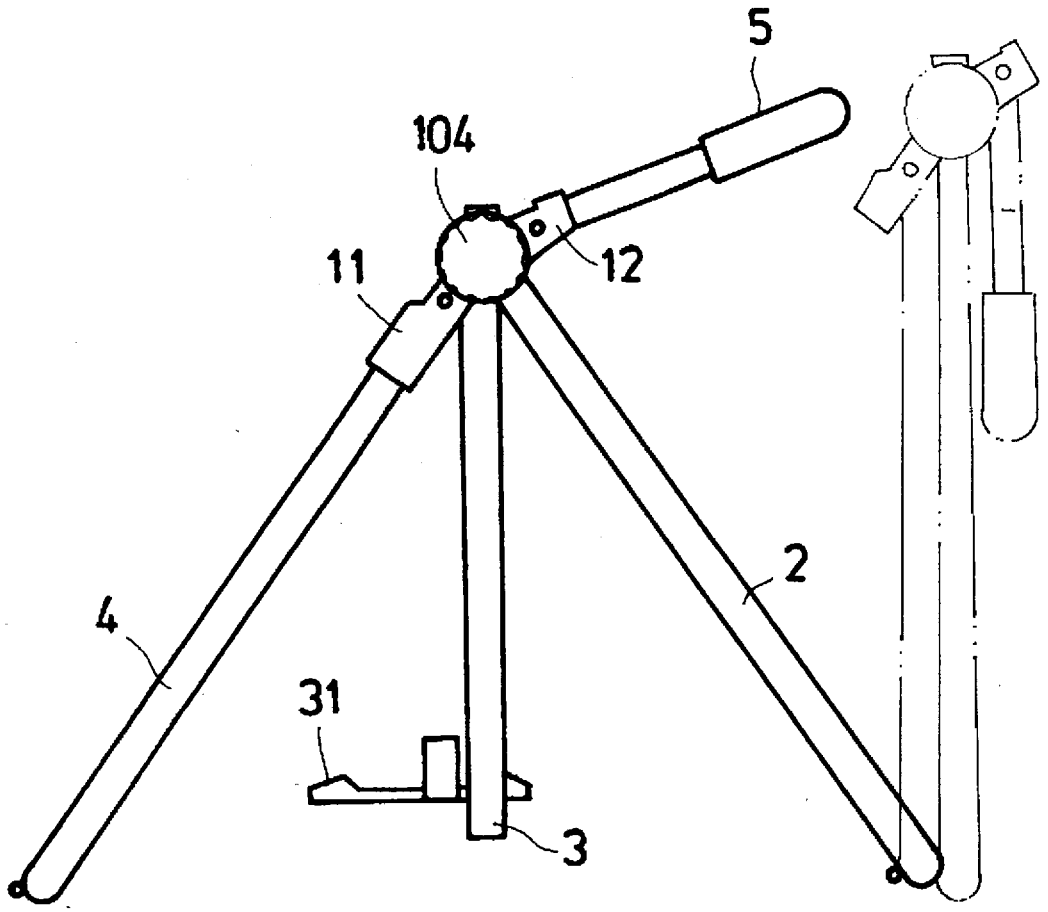
FIG. 3 illustrates how the present invention is collapsed.

Turning to FIG. 3, the walking exerciser can be easily collapsed when not in use. As shown, the handlebar 5 is pulled out of the holes 13 of the curved members 106 and then rotated downward. Thereafter, the U-shaped and H-shaped frames 4 and 2 are folded on the J-shaped frames 3 to collapse the walking exerciser.

I claim:

1. A walking exerciser comprising:

two J-shaped frames each provided with a circular disk at an outer end thereof and a pedal at a lower end thereof;

a H-shaped frame having two upper ends;

two connectors each fixedly mounted on one of said upper ends of said H-shaped frame, each of said connectors including a tubular member having a circular hole, two cylindrical plugs each force-fitted into one end of said tubular member, a first curved member fixedly installed on an upper portion of said tubular member, and a second curved member fixedly mounted on a lower portion of said tubular member;

two shafts each extending through said tubular member, said cylindrical plugs and said circular disk into one of said J-shaped frames and welded thereto;

a U-shaped frame having two upper ends each pivotally connected with said first curved member of said connectors; and a handlebar having two arms pivotally connected with said second curved member of said connectors and extending into said circular hole of said connectors.

2. The walking exerciser as claimed in claim 1, wherein said cylindrical plugs are each provided with a damping surface at both ends thereof.

3. The walking exerciser as claimed in claim 1, wherein said first and second curved members are formed with two recesses adapted to receive the ends of said U-shaped frame and handlebar.

4. The walking exerciser as claimed in claim 1, wherein said arms of said handlebar are each formed with an elongated slot adapted to receive a screw extending through said first curved member and said handlebar.

* * * * *